US007164398B2

(12) United States Patent
Matsumoto

(10) Patent No.: US 7,164,398 B2
(45) Date of Patent: Jan. 16, 2007

(54) APPARATUS AND METHOD FOR DRIVING PLASMA DISPLAY PANEL, AND PROCESSING PROGRAM EMBODIED IN A RECORDING MEDIUM FOR DRIVING PLASMA DISPLAY PANEL

(75) Inventor: Yukihiro Matsumoto, Fukuroi (JP)

(73) Assignee: Pioneer Corporation, Tokyo-to (JP)

( * ) Notice: Subject to any disclaimer, the term of this patent is extended or adjusted under 35 U.S.C. 154(b) by 474 days.

(21) Appl. No.: 10/808,381

(22) Filed: Mar. 25, 2004

(65) Prior Publication Data

US 2004/0189551 A1 Sep. 30, 2004

(30) Foreign Application Priority Data

Mar. 26, 2003 (JP) ..... P2003-084031

(51) Int. Cl.
*G09G 3/28* (2006.01)

(52) U.S. Cl. ..... 345/63; 345/60

(58) Field of Classification Search ..... 345/60–66
See application file for complete search history.

(56) References Cited

U.S. PATENT DOCUMENTS 5,519,518 A * 5/1996 Watanabe et al. ..... 349/57
6,582,380 B1 * 6/2003 Kazlausky et al. ..... 600/595
6,680,716 B1 * 1/2004 Nakamura ..... 345/60

* cited by examiner

*Primary Examiner*—Ricardo Osorio
(74) *Attorney, Agent, or Firm*—Sughrue Mion, PLLC

(57) ABSTRACT

A plasma display panel drive apparatus that executes a gradation display by having an address period in which light-emitting cells are set, and a sustain period in which the light-emitting cells that were set in the address period are repeatedly lit up, is provided with: a pulse-output device which outputs a drive pulse to the plasma display panel during the sustain period; a first intensity-level-detection device which detects the average intensity level; a second intensity-level-detection device which detects the intensity level of each discharge cell; and a pulse-voltage-control device which controls the pulse-output device such that the drive-pulse voltage changes based on the average intensity level detected by the first intensity-level-detection device, and the intensity level of each the discharge cell that was detected by the second intensity-level-detection device.

5 Claims, 3 Drawing Sheets

APPARATUS AND METHOD FOR DRIVING PLASMA DISPLAY PANEL, AND PROCESSING PROGRAM EMBODIED IN A RECORDING MEDIUM FOR DRIVING PLASMA DISPLAY PANEL

BACKGROUND OF THE INVENTION

1. Field of the Invention

This invention relates to a plasma display panel drive apparatus the executes a display by having an address period in which light-emitting cells are set, and a sustain period in which the light-emitting cells that were set in the address period light up a specified number of times.

2. Description of the Related Art

A plasma display drive apparatus that executes a gradation display by combining an address period in which light-emitting cells are set by forming a wall charge, and a sustain period in which only the discharge cells tat were cell that were set as light-emitting cells in the address period are selectively and repeatedly lit up, has been known. In this kind of plasma display panel drive apparatus, by changing the number of drive panels in the sustain period of one field, or in other words, by changing the number of times light is emitted, the light intensity of the corresponding discharge cells is changed.

However, in order to execute a gradation display, it is necessary to execute a series of processes for one field, and increasing the number of times light is emitted in the sustain period is limited by time. Therefore, from the aspect of intensity, there is a possibility that the potential performance of the plasma display panel will not be sufficiently obtained.

SUMMARY OF THE INVENTION

Taking the aforementioned situation into consideration, the object of the present invention is to provide a plasma display panel drive apparatus that makes it possible to sufficiently take advantage of the full potential performance of the plasma display panel.

The above object of the present invention can be achieved by a plasma display panel drive apparatus that executes a gradation display by having an address period in which light-emitting cells are set, and a sustain period in which the light-emitting cells that were set in the address period are repeatedly lit up. The apparatus is provided with: a pulse-output device which outputs a drive pulse to the plasma display panel during the sustain period; a first intensity-level-detection device which detects the average intensity level; a second intensity-level-detection device which detects the intensity level of each discharge cell; and a pulse-voltage-control device which controls the pulse-output device such that the drive-pulse voltage changes based on the average intensity level detected by the first intensity-level-detection device, and the intensity level of each the discharge cell that was detected by the second intensity-level-detection device.

According to the present invention, the number of sustain pulses differs according to the average intensity level that is detected by the average-intensity-detection unit. This is in order suppress the increase of power consumption and rise in panel temperature during high intensity, or to minimize the burden on the drive circuit. When the average intensity level is a less than predetermined minimum, the number of sustain pulses is not suppressed, and the number of sustain pulses is maintain according to the intensity of each picture element based on the video signal. However, when the average intensity level is greater than predetermined minimum, the number of sustain pulsed decreases the higher the average intensity level is.

Also, the control circuit changes the pulse voltage Vsus that is output from the drive circuit according to the average-intensity level that is detected by the average-intensity-detection unit.

In one aspect of the present invention can be achieved by the plasma display panel drive apparatus of the present invention. The a plasma display panel drive apparatus is, wherein the pulse-voltage-control device controls the pulse-output device by increasing the drive-pulse voltage when the average intensity level that is detected by the first intensity-level-detection device is less than a specified level, and the intensity level of each the discharge cell detected by the second intensity-level-detection device is greater than a specified level.

According to the present invention, when executing the display of an image having only a certain area that is bright, by increasing the pulse voltage, it is possible to increase the intensity of the bright area. Therefore, it is possible to take advantage of the maximum potential of the plasma display panel.

In another aspect of the present invention can be achieved by the plasma display panel drive apparatus of the present invention. The plasma display panel drive apparatus is, wherein the pulse-voltage-control device controls the pulse-output device by increasing the drive-pulse voltage according to the intensity level of each the discharge cell detected by the second intensity-level-detection device when the average intensity level that is detected by the first intensity-level-detection device is less than a specified level.

According to the present invention, when changing the voltage of the sustain pulse, the intensity per sustain pulse increases, and that affects the linearity of the intensity of the display image. However, the pulse voltage increases only when the average intensity is low, so loss of linearity in the intensity is not noticed, and in fact there is no feeling of loss of image quality.

The above object of the present invention can be achieved by a method of driving a plasma display panel that executes a gradation display by having an address period in which light-emitting cells are set, and a sustain period in which the light-emitting cells that were set in the address period are repeatedly lit up. The method of driving a plasma display panel is provided with: a pulse-output process of outputting a drive pulse to the plasma display panel during the sustain period; a first intensity-level-detection process of detecting the average intensity level; a second intensity-level-detection process of detecting the intensity level of each discharge cell; and a pulse-voltage-control process of controlling the pulse-output device such that the drive-pulse voltage changes based on the average intensity level detected by the first intensity-level-detection device, and the intensity level of each the discharge cell that was detected by the second intensity-level-detection device.

According to the present invention, when executing the display of an image having only a certain area that is bright, by increasing the pulse voltage, it is possible to increase the intensity of the bright area. Therefore, it is possible to take advantage of the maximum potential of the plasma display panel.

Furthermore, when changing the voltage of the sustain pulse, the intensity per sustain pulse increases, and that affects the linearity of the intensity of the display image. However, the pulse voltage increases only when the average intensity is low, so loss of linearity in the intensity is not noticed, and in fact there is no feeling of loss of image quality.

The above object of the present invention can be achieved by a driving a plasma display panel program embodied in a recording medium which can be read by a computer in a plasma display panel drive apparatus of the present invention. The driving a plasma display panel program embodied in a recording medium which can be read by a computer in a plasma display panel drive apparatus that executes a gradation display by having an address period in which light-emitting cells are set, and a sustain period in which the light-emitting cells that were set in the address period are repeatedly lit up, the program making the computer function as: a pulse-output device which outputs a drive pulse to the plasma display panel during the sustain period; a first intensity-level-detection device which detects the average intensity level; a second intensity-level-detection device which detects the intensity level of each discharge cell; and a pulse-voltage-control device which controls the pulse-output device such that the drive-pulse voltage changes based on the average intensity level detected by the first intensity-level-detection device, and the intensity level of each the discharge cell that was detected by the second intensity-level-detection device.

According to the present invention, when executing the display of an image having only a certain area that is bright, by increasing the pulse voltage, it is possible to increase the intensity of the bright area. Therefore, it is possible to take advantage of the maximum potential of the plasma display panel.

Furthermore, when changing the voltage of the sustain pulse, the intensity per sustain pulse increases, and that affects the linearity of the intensity of the display image. However, the pulse voltage increases only when the average intensity is low, so loss of linearity in the intensity is not noticed, and in fact there is no feeling of loss of image quality.

DESCRIPTION OF THE PREFERRED EMBODIMENTS

A first embodiment of the plasma display panel drive apparatus of this invention will be explained below with reference to the drawings.

Figure 1:
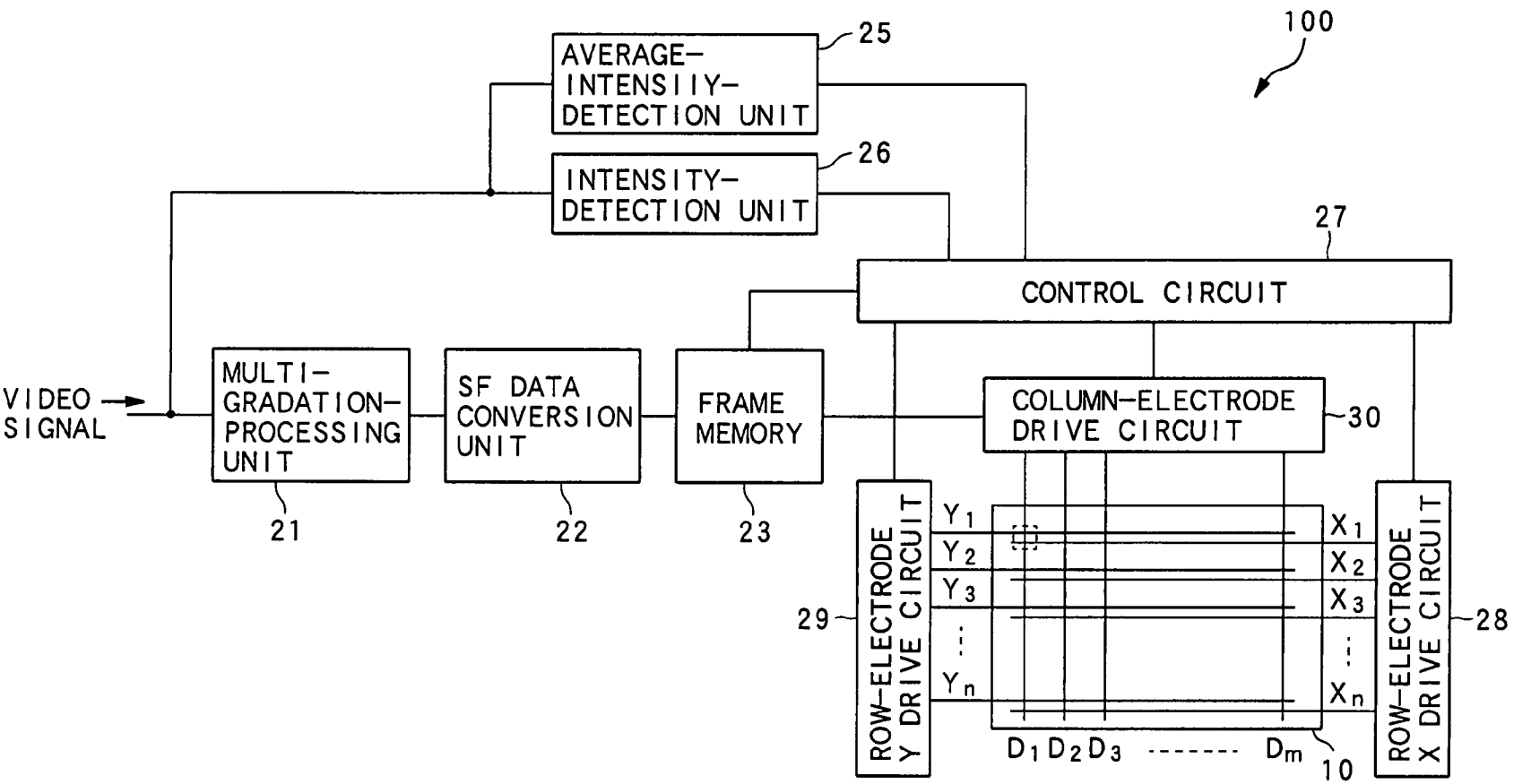
FIG. 1 is a block diagram showing the construction of the plasma display panel drive apparatus 100 of an embodiment of this invention.

FIG. 1 is a block diagram showing the construction of the plasma display panel drive apparatus 100 of an embodiment of this invention. As shown in FIG. 1, the plasma display panel drive apparatus 100 comprises: a multi-gradation-processing unit 21 that converts the input video signal to a signal for multi-gradation display; an SF data-conversion unit 22 that converts the signal output from the multi-gradation-processing unit 21 to a data for each sub-field to be described later; a frame memory 23 that stores in order the data output from the SF data-conversion unit 22; an average-intensity-detection unit 25 that detects the average intensity of the overall video based on the video signal; an intensity-detection unit 26 the detects the intensity of each discharge cell based on the video signal, and extracts the maximum intensity LX from among those intensities; a control circuit 27 that converts the data read in order from the frame memory 23 based on the average intensity L output from the average-intensity-detection unit 25 and the information from the intensity-detection unit 26, and creates control data for generating a drive pulse; a row-electrode X drive circuit 28 that drives the row electrodes X1 to Xn (described later) according to the control data from the control circuit 27; a row-electrode Y drive circuit 29 that drives row electrodes Y1 to Yn (described later) according to control data from the control circuit 27; and a column-electrode drive circuit 30 that drives column electrodes D1 to Dm (described later) according to control data from the control circuit 27.

As shown in FIG. 1, the plasma display panel 10 comprises: column electrodes D1 to Dn that are parallel with each other; and row electrodes X1 to Xn and row electrodes Y1 to Yn that are orthogonal to the column electrodes D1 to Dm. The row electrodes X1 to Xn and row electrodes Y1 to Yn are alternately placed, and an ith display line is formed by the pair of row electrode Xi ($1 \leqq i \leqq n$) and row electrode Yi ($1 \leqq i \leqq n$). The column electrodes D1 to Dm and row electrodes X1 to Xn, Y1 to Yn are formed by two substrates that face each other and are attached to seal in discharge gas, and the intersections where the column electrodes D1 to Dm cross the pairs of row electrodes X1 to Xn and row electrodes Y1 to Yn form discharge cells that become the display picture elements.

Figure 2:
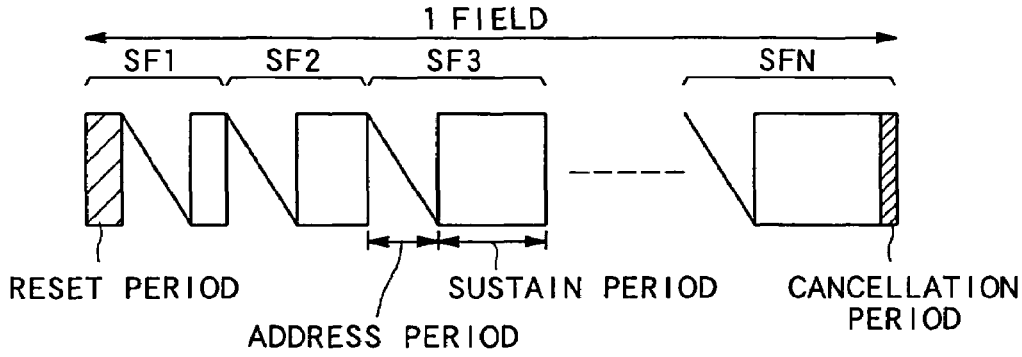
FIG. 2 is a drawing showing the construction of one field.

Next, the operation of the plasma display panel drive apparatus 100 of this embodiment will be explained with reference to FIG. 2 and FIG. 3.

The field, which is the period that drives the plasma display panel, is made up of a plurality of sub-fields SF1 to SFN. As shown in FIG. 2, in each sub-field there is an address period that selects the discharge cells to be lit up, and a sustain period the keeps the cells selected in the address period lit up for a specified amount of time. Also, at the start of SF1, which is the first sub-field, there is a reset period for resetting the lit up state of the previous field. In this reset period, all of the cells are reset to be either light-emitting cells (cell having a wall charge) or to be non-emitting cells (cell not having a wall charge). In the former case, specified cells are switched to being non-emitting cells in the following address period, and in the latter case, specified cells are switched to being light-emitting cells in the following address period. The sustain period gradually becomes longer in the order of the sub-fields SF1 to SFN, and by changing the number of sub-fields that continue to be lit up, the specified gradation display is possible.

Figure 3:
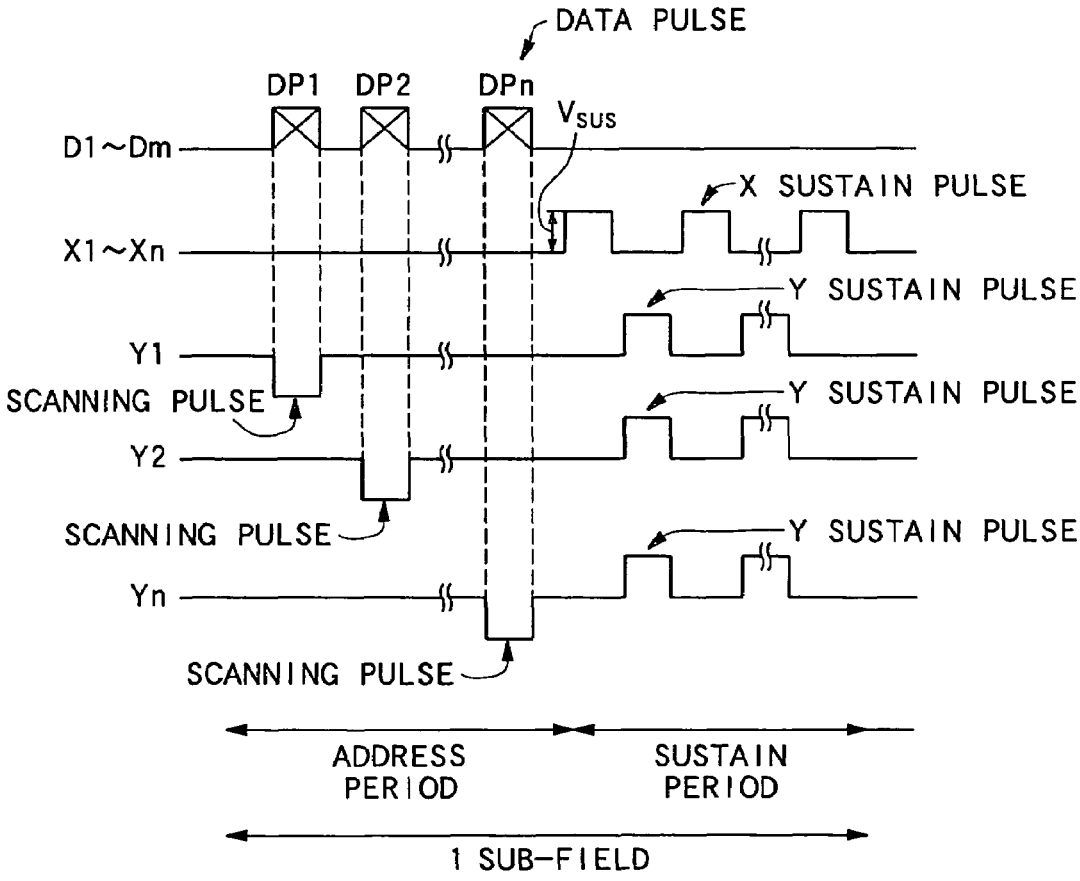
FIG. 3 is a drawing showing the drive pulse in one sub-field.

In the address periods of each of sub-fields shown in FIG. 3, address scanning is performed for each line. That is, at the same time that a scanning pulse is applied to the row electrode Y1 of the first line, a data pulse DP1 is applied to the column electrodes D1 to Dm according to the address data corresponding to the cells of the first line; then at the same time that a scanning pulse is applied to the row electrode Y2 of the second line, a data pulse DP2 is applied to the column electrodes D1 to Dm according to the address data corresponding to the cells of the second line. Similarly a scanning pulse and data pulse DP are applied simultaneously for the third line on as well. Finally, at the same time that a scanning pulse is applied to the row electrode Yn of the nth line, a data pulse DPn is applied to the column electrodes D1 to Dm according to the address data corresponding to the cells of the nth line. As described above, in the address period, specified cells are switched from being light-emitting cells to non-emitting cells, or are switched from being non-emitting cells are light-emitting cells.

After address scanning ends in this way, all of the cells in the sub-field are set respectively to being either light-emitting cells or non-emitting cells, and in the following sustain period, each time a sustain pulse is applied, only the light-emitting cells will repeatedly emit light. As shown in FIG. 3, in the sustain period, an X sustain pulse and Y sustain pulse are repeatedly applied at a specified timing to the row electrodes X1 to Xn and row electrodes Y1 to Yn, respectively. Also, in the last sub-field SFN, there is a cancellation period in which all of the cell are set to being non-emitting cells.

Figure 4:
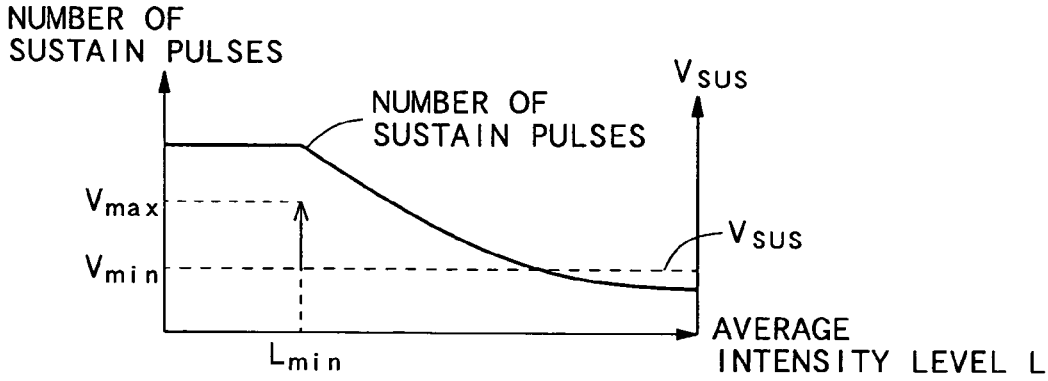
FIG. 4 is a drawing showing the relationship between the average intensity level and the number of sustain pulses and the pulse voltage Vsus.

FIG. 4 is a drawing showing the relationship between the average intensity level and the number of sustain pulses in the sustain period, and the pulse voltage Vsus of the sustain pulses applied to the row electrodes X1 to Xn in the sustain period. The number of sustain pulses and the pulse voltage Vsus are control by a process of the control circuit 27.

The number of sustain pulses shown in FIG. 4 is the maximum number of times light is emitted in one field. This number corresponds to the number of times the discharge cells emit light when specified discharge cells repeatedly emit light during all of the sustain periods of one field.

As shown in FIG. 4, the number of sustain pulses differs according to the average intensity level L that is detected by the average-intensity-detection unit 25. This is in order suppress the increase of power consumption and rise in panel temperature during high intensity, or to minimize the burden on the drive circuit. As shown in FIG. 4, when the average intensity level L is a less then Lmin, the number of sustain pulses is not suppressed, and the number of sustain pulses is maintain according to the intensity of each picture element based on the video signal. However,when the average intensity level is greater than Lmin, the number of sustain pulsed decreases the higher the average intensity level L is.

Also, in this embodiment, the control circuit 27 changes the pulse voltage Vsus that is output from the row-electrode X drive circuit 28 according to the average-intensity level L that is detected by the average-intensity-detection unit 25.

Figure 5:
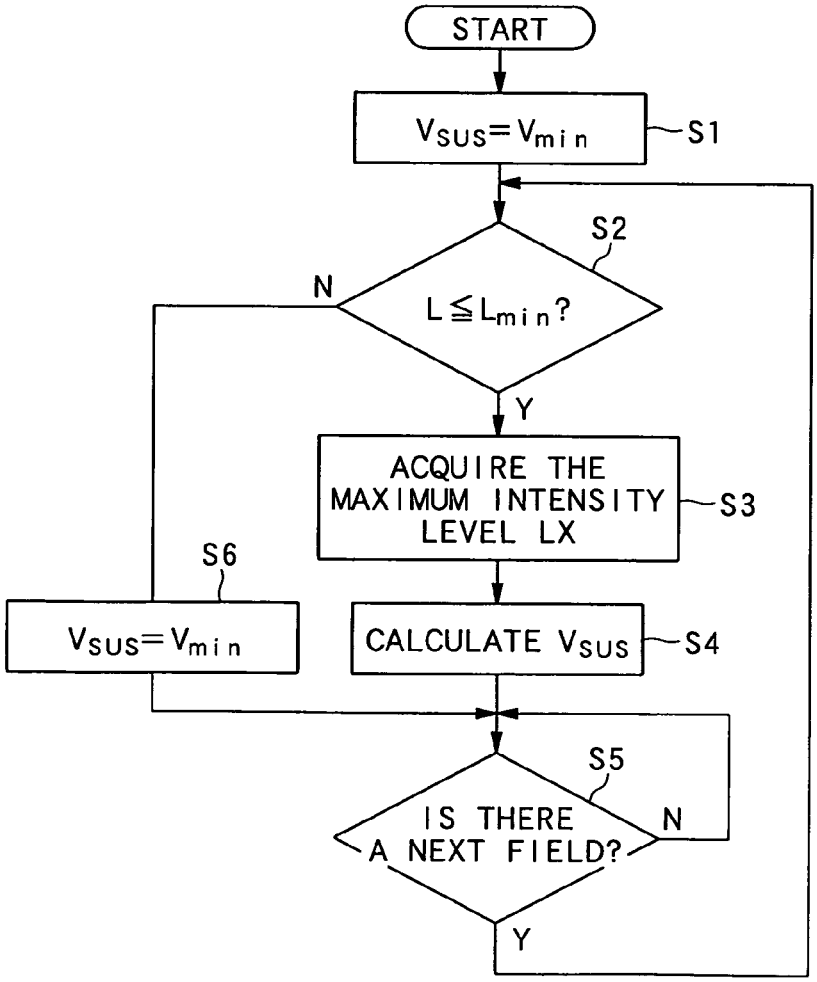
FIG. 5 is a flowchart showing the processing by the control circuit that controls the pulse voltage Vsus.

FIG. 5 is a flowchart showing the process of the control circuit 27 that controls the pulse voltage Vsus that is output from the row-electrode X drive circuit 28. As shown in FIG. 5, in this process, the initial value of the pulse voltage Vsus is set to Vmin (step S1). Next, the control circuit 27 determines whether or not the average-intensity level L detected by the average-intensity-detection unit 25 is less than Lmin (step S2), and when it is determined that it is less, the control circuit 27 acquires the maximum intensity LX from the intensity-detection unit 26 from among the intensities of each of the discharge cells (step S3). However, in step S2 when it is determined that the average-intensity level L is not less than Lmin, the control circuit sets the voltage of the pulse voltage Vsu to Vmin (step S6) and advances to step S5.

Next, instep S4, the control unit 27 calculates the pulse voltage Vsus based on the maximum intensity LX acquired in step S3, and sets the pulse voltage Vsus to the calculated value. In this case, the value of the pulse voltage Vsus is greater than Vmin and less than Vmax. For example, when the maximum intensity LX is lower than a specified intensity, the voltage of the pulse voltage Vsus is not increased but is kept at Vmin. However, when the maximum intensity LX is very high, the pulse voltage Vsus is set to Vmax. When the maximum intensity LX is between those values, the pulse voltage Vsus is set to a value between Vmin and Vmax according to that intensity.

Next, in step S5, at the timing for going to the processing for the next field, the control circuit 27 returns to step S2 and repeats the same process for the next field.

In step S4, the case when the maximum intensity LX is somewhat large and the pulse voltage Vsus is set to a voltage larger than Vmin, is the case when the average-intensity L is small (step S2: YES) and the maximum intensity LX is somewhat large. That is, the case where there are many dark areas in the image, however, only a certain area is very bright or somewhat bright, corresponds to this case.

In this embodiment, when executing the display of an image having only a certain area that is bright, by increasing the pulse voltage Vsus, it is possible to increase the intensity of the bright area. Therefore, it is possible to take advantage of the maximum potential of the plasma display panel.

Moreover, generally, when changing the voltage of the sustain pulse, the intensity per sustain pulse increases, and that affects the linearity of the intensity of the display image. However, in this embodiment, the pulse voltage Vsus increases only when the average intensity is low, so loss of linearity in the intensity is not noticed, and in fact there is no feeling of loss of image quality.

In this embodiment, an example was given in which, when the average intensity L is less than Vmin, the pulse voltage Vsus was set to a value according to the maximum intensity LX, however, the plasma display panel drive apparatus of this invention is not limited to this example. It is also possible to set the voltage of the sustain pulse based on other information obtained fro the intensity-detection unit 26, and to hand the average intensity L using a different method.

Furthermore, in this embodiment, an example of changing the voltage of the X sustain pulse was given, however it is also possible to change the voltage of the Y sustain pulse, or to change the voltages of both sustain pulses at the same time.

In the embodiment and scope of the invention described above, the row-electrode X drive circuit 28 corresponds to a 'pulse-output device', the average-intensity-detection unit 25 corresponds to a 'first intensity-level-detection device', the intensity-detection unit 26 corresponds to a 'second intensity-level-detection device', and the control circuit 27 corresponds to a 'pulse-voltage control device'.

It should be understood that various alternatives to the embodiment of the invention described herein may be employed in practicing the invention. Thus, it is intended that the following claims define the scope of the invention and that methods and structures within the scope of these claims and their equivalents be covered thereby.

The entire disclosure of Japanese Patent Application No. 2003-84031 filed on Mar. 26, 2003 including the specification, claims, drawings and summary are incorporated herein by reference in its entirety.

What is claimed is:

1. A plasma display panel drive apparatus that executes a gradation display by having an address period in which light-emitting cells are set, and a sustain period in which the light-emitting cells that were set in the address period are repeatedly lit up, comprising:

a pulse-output device which outputs a drive pulse to the plasma display panel during the sustain period;

a first intensity-level-detection device which detects the average intensity level;

a second intensity-level-detection device which detects the intensity level of each discharge cell; and a pulse-voltage-control device which controls the pulse-output device such that the drive-pulse voltage changes based on the average intensity level detected by the first intensity-level-detection device, and the intensity level of each the discharge cell that was detected by the second intensity-level-detection device.

2. The plasma display panel drive apparatus according to claim 1, wherein the pulse-voltage-control device controls the pulse-output device by increasing the drive-pulse voltage when the average intensity level that is detected by the first intensity-level-detection device is less than a specified level, and the intensity level of each the discharge cell detected by the second intensity-level-detection device is greater than a specified level.

3. The plasma display panel drive apparatus according to claim 1, wherein the pulse-voltage-control device controls the pulse-output device by increasing the drive-pulse voltage according to the intensity level of each the discharge cell detected by the second intensity-level-detection device when the average intensity level that is detected by the first intensity-level-detection device is less than a specified level.

4. A method of driving a plasma display panel for executing a gradation display by having an address period in which light-emitting cells are set, and a sustain period in which the light-emitting cells that were set in the address period are repeatedly lit up, the method comprising:

a pulse-output process of outputting a drive pulse to the plasma display panel during the sustain period;

a first intensity-level-detection process of detecting the average intensity level;

a second intensity-level-detection process of detecting the intensity level of each discharge cell; and a pulse-voltage-control process of controlling the pulse-output device such that the drive-pulse voltage changes based on the average intensity level detected by the first intensity-level-detection device, and the intensity level of each the discharge cell that was detected by the second intensity-level-detection device.

5. A driving a plasma display panel program embodied in a recording medium which can be read by a computer in a plasma display panel drive apparatus that executes a gradation display by having an address period in which light-emitting cells are set, and a sustain period in which the light-emitting cells that were set in the address period are repeatedly lit up, the program making the computer function as:

a pulse-output device which outputs a drive pulse to the plasma display panel during the sustain period;

a first intensity-level-detection device which detects the average intensity level;

a second intensity-level-detection device which detects the intensity level of each discharge cell; and a pulse-voltage-control device which controls the pulse-output device such that the drive-pulse voltage changes based on the average intensity level detected by the first intensity-level-detection device, and the intensity level of each the discharge cell that was detected by the second intensity-level-detection device.

* * * * *